US008283021B2

(12) United States Patent
Ashida et al.

(10) Patent No.: US 8,283,021 B2
(45) Date of Patent: Oct. 9, 2012

(54) LEATHER-LIKE SHEET AND METHOD OF PRODUCING LEATHER-LIKE SHEET

(75) Inventors: Tetsuya Ashida, Okayama (JP); Daisuke Tanaka, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 828 days.

(21) Appl. No.: 12/306,546

(22) PCT Filed: Jun. 25, 2007

(86) PCT No.: PCT/JP2007/062684

§ 371 (c)(1),
(2), (4) Date: Dec. 24, 2008

(87) PCT Pub. No.: WO2008/001716

PCT Pub. Date: Jan. 3, 2008

(65) Prior Publication Data

US 2009/0186724 A1 Jul. 23, 2009

(30) Foreign Application Priority Data

Jun. 27, 2006 (JP) ..... 2006-176524

(51) Int. Cl.

| | |
|---|---|
| ***D06N 3/00*** | (2006.01) |
| *A63B 41/00* | (2006.01) |
| *A63B 41/08* | (2006.01) |
| *B32B 3/10* | (2006.01) |
| *B32B 3/26* | (2006.01) |

(52) U.S. Cl. ..... 428/151; 428/904; 428/131; 428/132; 428/134; 428/136; 428/137; 428/138; 428/159; 428/160; 264/45.5; 264/46.3; 473/569; 473/596; 473/598; 473/599; 473/607

(58) Field of Classification Search ..... 428/904, 428/151, 131, 132, 133, 134, 135, 136, 137, 428/138, 139, 159, 160; 264/119, 663, 74, 264/500, 120, 220, 221, 222, 45.5, 46.3; 473/569, 573, 574, 594, 595, 596, 597, 598, 473/599, 603, 604, 605, 606, 607
See application file for complete search history.

(56) References Cited

U.S. PATENT DOCUMENTS 6,024,661 A 2/2000 Guenther et al.
(Continued)

FOREIGN PATENT DOCUMENTS

EP 1 604 710 A1 12/2005
(Continued)

OTHER PUBLICATIONS

Analyses of Structures for a Synthetic Leather made of Polyurethane and Microfiber, Journal of Applied Polymer Science, vol. 103, 903-908, pub. online Oct. 27, 2006.*

(Continued)

*Primary Examiner* — David Sample
*Assistant Examiner* — Kendra Keith
(74) *Attorney, Agent, or Firm* — Oblon, Spivak, McClelland, Maier & Neustadt, L.L.P.

(57) ABSTRACT

An object of the invention is to provide a leather-like sheet having excellent water absorbability (sweat absorbability, defined the same hereinafter), providing a natural leather-like touch, and suitably used as a ball covering or a non-slip covering, without lowering surface wear resistance. An aspect of the invention is directed to a leather-like sheet including a base material having an entangled fiber sheet; and a porous elastic resin layer laminated on a surface of the base material. The porous elastic resin layer has a concave-convex surface. The concave-convex surface of the porous elastic resin layer includes a projection having a top surface and a side surface, and a recess having a bottom surface contiguous to the side surface. The top surface of the projection has openings with a diameter from 10 to 500 nm at a density of 1,000 openings/mm$^2$ or more.

20 Claims, 6 Drawing Sheets

U.S. PATENT DOCUMENTS

| | | | | |
|---|---|---|---|---|
| 2001/0024709 | A1 | 9/2001 | Yoneda et al. | |
| 2004/0185245 | A1 | 9/2004 | Akamata et al. | |
| 2006/0199686 | A1* | 9/2006 | Mimura et al. | 473/605 |

FOREIGN PATENT DOCUMENTS

| | | |
|---|---|---|
| JP | 63-152483 | 6/1988 |
| JP | 63-197475 | 12/1988 |
| JP | 7-30285 | 4/1995 |
| JP | 2000-328465 | 11/2000 |
| JP | 2002 69857 | 3/2002 |
| JP | 2004 263343 | 9/2004 |
| JP | 2004-277961 | 10/2004 |
| JP | 2004 300656 | 10/2004 |
| JP | 2005-2533 | 1/2005 |
| JP | 2005 15951 | 1/2005 |

OTHER PUBLICATIONS

Office Action issued on Oct. 11, 2011 in the corresponding Japanese Patent Application No. 2008-522562 (with English Translation).

Extended European Search Report issued Nov. 8, 2011, in Patent Application No. 07767491.9.

* cited by examiner

LEATHER-LIKE SHEET AND METHOD OF PRODUCING LEATHER-LIKE SHEET

TECHNICAL FIELD

The present invention relates to a leather-like sheet preferably used as a ball covering or a non-slip covering, and a method of producing the leather-like sheet.

BACKGROUND ART

Multitudes of kinds of leather-like sheets have been proposed as a ball covering or a non-slip covering requiring non-slip properties.

For instance, patent document 1 discloses a covering composition for imparting slip resistance to a surface of a base material, wherein the covering composition contains a polyurethane resin having a hydroxyl group in a molecule thereof, a liquid rubber having a hydroxyl group in a molecule thereof, an inorganic filler or an organic filler, and an isocyanate prepolymer. A cover layer made of the composition has a certain degree of water absorbability. However, if the water absorption amount is unduly increased, the non-slip performance of the cover layer may be lowered. Accordingly, in the case where the cover layer is frequently contacted with a human hand, the cover layer may be softened, and the touch of the cover layer may vary resulting from absorbing a large amount of sweat. In particular, for instance, in a condition that a basketball with the cover layer is continuously or continually used for a long time, and the cover layer is contacted with a large amount of sweat during a game, the above drawback is particularly serious.

Patent document 2 discloses a non-slip covering produced by impregnating and solidifying a resin having rubber viscoelasticity, with a needle-punched non-woven fabric being used as a core member, to form a foamed sheet-like member, and slicing the foamed sheet-like member at a position corresponding to an intermediate layer thereof, wherein a sliced surface of the non-slip covering has a porous configuration. Since the non-slip covering has a soft surface, and a small surface strength, the non-slip covering is likely to wear out. Also, because of a high tackiness, the non-slip covering has a poor durability in using as a covering for a ball such as a basketball.

Patent document 3 discloses a synthetic leather produced by; mixing gelatin to a synthetic rubber elastic material; subjecting the mixture to foaming while heating to obtain a foamed molded product; removing a part of a surface skin layer of the molded product; and removing the gelatin by hot water, wherein a porous structure is formed on a surface of the molded product. The above synthetic leather has drawbacks that the surface of the synthetic leather has a high tackiness, and a low apparent density. Accordingly, the synthetic leather has a low wear resistance, and a poor durability in using as a ball covering.

Patent document 4 discloses a leather-like sheet comprising; an entangled fiber sheet; a porous base layer made of a porous elastic material and a penetrating agent filled in the cavity of the entangled fiber sheet; and a porous outer layer formed on a surface of the porous base layer, wherein openings (microholes) having an average diameter from 50 to 100 μm are formed in a surface of the porous outer layer at a density from 300 to 10,000 openings/cm$^2$, and the penetrating agent is filled in the openings. Because of multitudes of large openings in the entirety of the surface of the leather-like sheet, the apparent density of the leather-like sheet surface is likely to be reduced, with the result that the leather-like sheet is likely to wear out. Accordingly, in the case where the leather-like sheet is used as a ball covering, a long-time use of the ball may deprive the concave-convex configuration of the ball. Also, recesses of the leather-like sheet are likely to be stained. In the case where the recesses are stained, the stains are less likely to be removed. Further, the penetrating agent filled in the openings may be dissolved by sweat of the players during a game, with the result that the ball surface may be slippery.

Patent document 5 discloses a sweat-absorbing game ball, wherein a polyurethane wet coagulated cover layer is laminated on a surface of a fiber member containing polyurethane, the cover layer surface has projections, and recesses between the projections, and a plurality of openings are formed in side surfaces of the projections. The projection side surfaces may be stained by a long time use of the ball. In the case where the projection side surfaces are stained, the stains are less likely to be removed. Also, in the case the ball is stained, sweat absorbability may be lowered, and a natural leather-like touch may not be obtained.

Patent document 6 discloses a leather-like sheet for use in a ball, comprising an entangled fiber sheet, and a porous outer layer laminated on a surface of the entangled fiber sheet and having a concave-convex configuration, wherein surfaces of the projections of the porous outer layer have microholes (openings) with an average diameter from 5 to 100 μm, and surfaces of the recesses are substantially devoid of openings. The openings are formed by buffing the projection surfaces with use of a sand paper, a wire cloth, or a like tool, or dissolving the projection surfaces with use of a solvent. The openings to be formed by the above method may have an unduly large diameter. As a result, the apparent density of the ball surface may be reduced, and the ball is likely to wear out during a game. The wear may further increase the size of the openings, or diminish the openings. As a result, sweat absorbability may be lowered, and grip performance of the ball may be lowered. Also, an unduly large diameter of the openings is likely to cause stains on the ball surface.

Patent document 7 discloses a skin covering for a ball, comprising: a base layer, and a coat layer which is formed on a surface of the base layer, made of a porous polymeric elastic material, and has a concave-convex configuration, wherein openings of about 0.5 to 50 μm are formed in side surfaces of the projections at a density of 1,000 openings/cm$^2$ or more. The openings are formed by; applying a surface treatment on a skin layer constituted of the porous polymeric elastic material with use of an organic solvent; subjecting the treated surface to an embossing treatment with a die having a concave-convex surface of 1 mm or more in height difference; and forming a cover layer made of a polymeric elastic material on top surfaces of the projections by coating. In use of a ball having a concave-convex surface with large pores solely in side surfaces of the projections, as described above, the projection side surfaces are likely to be stained, and the stains are less likely to be removed. Also, because the cover layer made of the polymeric elastic material is formed on the projection top surfaces, the touch of the ball may be degraded.

Patent document 1: JP No. Hei 7-30285B
Patent document 2: Japanese UM Publication No. Sho 63-197475A
Patent document 3: JP No. Sho 63-152483A
Patent document 4: JP No. 2000-328465A
Patent document 5: U.S. Pat. No. 6,024,661
Patent document 6: JP No. 2004-300656A
Patent document 7: JP No. 2004-277961A

DISCLOSURE OF THE INVENTION

In view of the above, it is an object of the invention to provide a leather-like sheet having excellent water absorbability (sweat absorbability, as defined the same hereinafter), providing a natural leather-like touch, and suitably used as a ball covering or a non-slip covering, without lowering surface wear resistance.

An aspect of the invention is directed to a leather-like sheet comprising: a base material including an entangled fiber sheet; and a porous elastic resin layer laminated on a surface of the base material, wherein the porous elastic resin layer has a concave-convex surface, the concave-convex surface of the porous elastic resin layer includes a projection having a top surface and a side surface, and a recess having a bottom surface contiguous to the side surface, and the top surface of the projection has openings with a diameter from 10 to 500 nm at a density of 1,000 openings/mm$^2$ or more.

These and other objects, features and advantages of the present invention will become more apparent upon reading of the following detailed description along with the accompanying drawings.

BEST MODE FOR CARRYING OUT THE INVENTION

In the following, an embodiment of the invention is described referring to the accompanying drawings. The embodiment is merely an example embodying the invention, and does not limit the technical scope of the invention.

Figure 1:
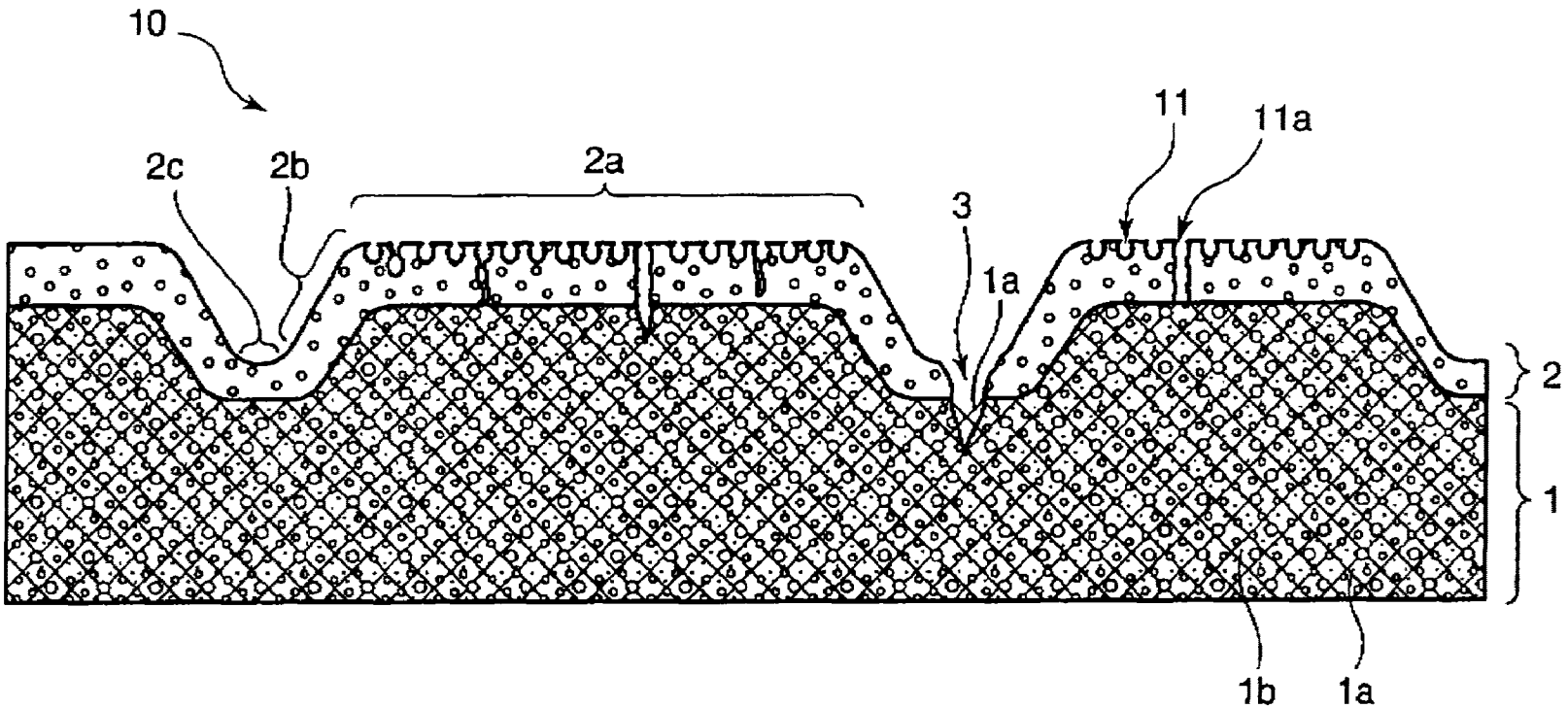
FIG. 1 is a cross-sectional view of a leather-like sheet embodying the invention.

FIG. 1 is a cross-sectional view of a leather-like sheet 10 embodying the invention. 1 indicates a base material including an entangled fiber sheet, 1*a* indicates the entangled fiber sheet, 1*b* indicates a porous elastic resin, 2 indicates a porous elastic resin layer having a concave-convex surface, 2*a* indicates a projection top surface, 2*b* indicates a projection side surface, 2*c* indicates a recess bottom surface, and 3 indicates a crack. The projection top surface 2*a* of the leather-like sheet 10 has openings 11 with a diameter from 10 to 500 nm at a density of 1,000 openings/mm$^2$ or more.

In the following, the elements constituting the leather-like sheet 10 are described.

The base material 1 including the entangled fiber sheet 1*a* is constituted of the entangled fiber sheet 1*a*, and the porous elastic resin 1*b* impregnated in the entangled fiber sheet 1*a*.

A knitted/woven fabric made of fibers, a non-woven fabric, or a like fabric may be used as the entangled fiber sheet with no specific limitation.

Examples of the fibers for forming the entangled fiber sheet include cellulose-based fibers, acrylic-based fibers, polyester-based fibers, and polyamide-based fibers. These fibers may be used alone or in combination of two or more kinds.

The average fineness of the fibers is 0.3 dtex or less, and preferably 0.0001 to 0.1 dtex to provide a leather-like sheet with a soft texture similar to a texture of natural leather. The fibers having the above fineness are generally called microfine fibers.

The weight per unit area of the entangled fiber sheet is preferably 200 to 1,000 g/m$^2$, and further preferably, 300 to 800 g/m$^2$. In the case where the entangled fiber sheet satisfies the above requirement on the weight per unit area, the entangled fiber sheet exhibits satisfactory cushion function. Thereby, a surface of the porous elastic resin layer is allowed to have an intended concave-convex configuration. In the case where the entangled fiber sheet satisfies the above requirement on the weight per unit area, the cracks 3 are formed in the recess bottom surface 2*c*. Thereby, the fibers constituting the entangled fiber sheet 1*a* are easily exposed through a part of the cracks 3. The condition that the fibers are exposed through the crack is preferable to easily absorb a water component on the leather-like sheet surface through the crack portion by utilizing a capillary action.

The base material 1 including the entangled fiber sheet 1*a* has the sponge-like porous elastic resin 1*b* impregnated in the entangled fiber sheet 1*a*.

Containing the porous elastic resin in the base material having the entangled fiber sheet is preferable to provide the leather-like sheet with a natural leather-like touch. Further, use of the leather-like sheet as a ball covering is preferable to provide an improved touch on the ball surface and increased bounce, and improve stitching performance in producing a ball.

A conventional elastic resin for use in producing a leather-like sheet may be used for the porous elastic resin 1*b* with no specific limitation.

Specific examples of the elastic resin are polyurethane-based resins; polyester-based elastomers; various rubbers; polyvinyl chloride resins; polyacrylic-based resins; polyamino-based acid resins; silicone-based resins; and modifiers, copolymers, and mixtures of these resins. Among these, polyurethane-based resins are preferable to secure a texture, a mechanical property, and a like property in a well-balanced state.

The mass ratio of the entangled fiber sheet 1*a* and the porous elastic resin 1*b* in the base material 1 is optionally selected depending on an intended physical property or texture.

The thickness of the base material 1 is optionally selected depending on a purpose of use. For instance, in the case where the leather-like sheet is used as a ball covering, the thickness from about 0.4 to 3.0 mm is preferable to produce a ball having a mechanical property, a weight, a texture, and a like property in a well-balanced state.

As shown in FIG. 1, the porous elastic resin layer 2 includes, on a concave-convex surface thereof, the projection top surface 2*a*, the projection side surface 2*b*, and the recess bottom surface 2*c* contiguous to the projection side surface 2*b*. The projection top surface 2*a* has the openings 11 with a diameter from 10 to 500 nm at a density of 1,000 openings/mm$^2$ or more. Preferably, the projection side surface 2*b* and the recess bottom surface 2*c* are substantially devoid of openings.

The porous elastic resin layer 2 may be made of an elastic resin of the same kind as the elastic resin contained in the base material. Among the examples of the elastic resin, polyurethane-based resin is preferably used to secure elasticity, softness, wear resistance, and formability of a porous structure.

A particularly preferable example of polyurethane-based resin is a low modulus polyurethane elastomer with a load at an elongation stress of 100% about 20 to 100 kg/cm$^2$ to secure wear resistance and grip performance in a well-balanced state. An unduly small load at an elongation stress of 100% is likely to lower wear resistance, and an unduly large an load at an elongation stress of 100% is likely to lower grip performance.

Figure 2:
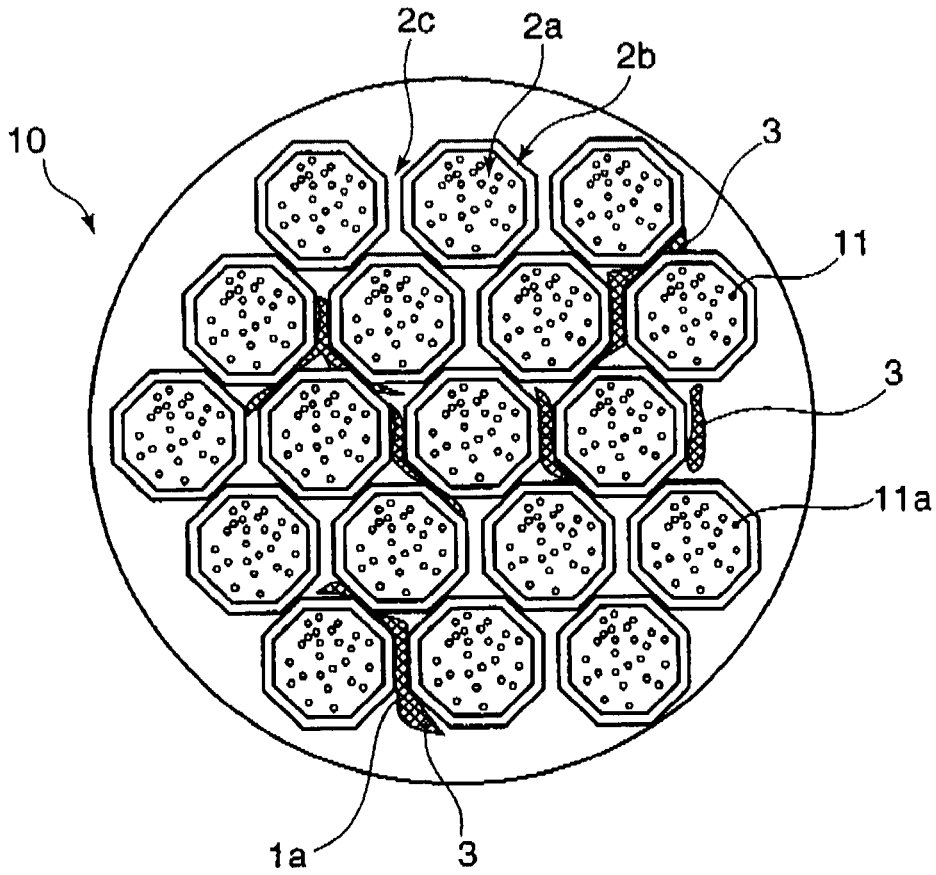
FIG. 2 is a top plan view of the leather-like sheet of the embodiment.

FIG. 2 is a top plan view of the leather-like sheet 10 of the embodiment.

As schematically shown in FIG. 2, the projection top surface 2*a* has openings with a diameter from 10 to 500 nm at a density of 1,000 openings/mm$^2$ or more. The multitudes of nano-order microfine openings 11 in the projection top surface 2*a* provides the leather-like sheet with excellent water absorbability (sweat absorbability) and excellent grip performance in wet condition, without lowering surface wear resistance. Accordingly, in the case where the leather-like sheet is used as a ball covering in a condition that the ball is continuously or continually used for a long time, and is contacted with a large amount of sweat during a game, sweat is less likely to remain on the ball surface due to the excellent sweat absorbability. Thereby, high grip performance can be secured. Also, since the openings 11 are formed in the projection top surface 28 in a micro size and with a high density, the apparent density of the ball surface can be relatively high, accordingly, high wear resistance can be secured.

The projection top surface is a plane including the vicinity of an apex of a projection on the surface of the porous elastic resin layer 2. In view of a fact that the projection top surface is not necessarily a horizontal flat surface, the projection top surface may not be strictly defined. In view of the above, the projection top surface may be defined as a plane in contact with a user's palm, when the user's palm is lightly placed on the concave-convex surface of the leather-like sheet. In the case where the leather-like sheet is used as a ball covering, the projection top surface may be defined as a plane in contact with the user's palm when the ball is held by the user's palm or palms. In use of a ball having the plane contactable with the user's palm, wherein the plane has the microfine openings 11 at a density of 1,000 openings/mm$^2$ or more, satisfactory excellent grip performance in wet condition can be secured by allowing the ball surface to absorb sweat of the user's palm through the microfine openings. Also, the ball provides a natural leather-like touch.

Specifically, the projection top surface may be defined as a surface including an apex of a projection, in the case where a cross-section of the leather-like sheet is observed by a scanning electron microscope with a magnification of 40 times. More specifically, the projection top surface may be defined as a portion in contact with a surface of a flat plate, in the case where a surface of the leather-like sheet having a concave-convex configuration is applied with a load of 5 kg/cm$^2$ via the flat plate.

On the other hand, the recess bottom surface is a bottom surface of a recess to be formed between adjacent projections. More specifically, the recess bottom surface may be defined as a bottom surface of a recess, in the case where the cross-section of the leather-like sheet is observed by the scanning electron microscope with a magnification of 40 times. Also, the projection side surface is a surface contiguous to the projection top surface and the recess bottom surface.

The projection top surface 2*a* has the openings 11. The number of the openings 11 is 1,000/mm$^2$ or more, and preferably 1,500/mm$^2$ or more. In the case where the number of the openings 11 is smaller than 1,000/mm$^2$, sufficient water absorbability and grip performance cannot be secured. Although the upper limit of the number of the openings 11 is not specifically limited. However, in the case where the number exceeds 5,000/mm$^2$, particularly 10,000/mm$^2$, wear resistance is likely to be lowered.

The diameter of the openings 11 is from 10 to 500 nm, preferably from 30 to 300 nm, and more preferably from 50 to 200 nm. In the case where the diameter of the openings 11 is from 10 to 500 nm, wear resistance can be sufficiently secured, and water absorbability can be improved. Also, a natural leather-like touch or slimy touch fittability at a fingertip can be retained.

The diameter of the openings 11 is a diameter of a circle of equivalent area to be measured by the following method. A surface of the leather-like sheet may be observed by a scanning electron microscope (SEM) with a magnification of 1,000 times. Ten projections are optionally selected out of the observed projections. Then, an area of each of the openings observed within the top surfaces of the ten projections is calculated. Then, an imaginary circle having an area equal to the area of each of the openings is defined, and the diameter of the imaginary circle is defined as the diameter of a circle of equivalent area.

It is preferable to form solely the openings substantially of a size from 10 to 500 nm in the projection top surface 2*a*. However, as far as the effect of the invention is not impaired, openings having a size other than the aforementioned size, which may be incidentally formed in a production process, may be allowed.

The height difference between a recess and a projection (height from a bottom point of the recess bottom surface to an apex of the projection top surface) is adjusted depending on the purpose of use. In the case where the leather-like sheet is used as a ball covering, the average height difference is preferably from 100 to 500 μm, and further preferably from 200 to 400 μm to secure excellent non-slip performance and grip performance. An unduly small height difference is likely to lower non-slip performance, and an unduly large height difference is likely to lower grip performance.

A part of the openings 11 is preferably continuous holes 11*a* communicating with the base material 1. In the case where the continuous holes 11*a* communicating with the base material 1 are formed, a water component on the leather-like sheet surface is migrated to the base material 1 through the continuous holes 11*a* by a capillary action or a like action. Thereby, enhanced water absorbability is secured. The continuous holes 11*a* may be formed by adjusting the thickness or the porosity of the porous elastic resin layer 2.

The projection side surface 2*b* is a plane between the projection top surface 2*a* and the recess bottom surface 2*c*. Preferably, the projection side surface 2*b* is substantially devoid of openings. In the case where multitudes of openings are formed in the projection top surface 2*a*, stains may intrude into the openings, and the stains are less likely to be removed. As a result, the ball is likely to be stained by a long-term use, which is not preferable. In particular, in the case where large openings are formed in the projection side surface 2*b*, the ball is likely to be stained.

The recess bottom surface 2*c* is a plane including a floor of a valley to be formed between adjacent projections. Preferably, the recess bottom surface 2*c* is substantially devoid of openings. In the case where openings are formed in a recess bottom surface, openings are formed in a mostly part on the surface of the porous elastic resin layer. This may reduce the apparent density of the porous elastic resin layer, and the ball surface is likely to wear out. As a result, a long-time use of the ball may deprive the concave-convex configuration of the ball. Also, stains are likely to be intruded in the openings, and the stains are less likely to be removed.

As shown in FIGS. 1 and 2, preferably, the cracks 3 are formed in the recess bottom surface 2*c*, and the fibers 1*a* constituting the entangled fiber sheet are exposed through a part of the cracks 3. In the case where the cracks are formed, and the fibers are exposed through the cracks, a water component on the leather-like sheet surface is easily absorbed by a capillary action through the cracks. Thereby, wet grip performance can be sufficiently secured.

The shape of the concave-convex surface 2 is not specifically limited, as far as having the projections, and recesses adjacent the projections are formable. A conventional emboss configuration such as a stone grain pattern or a sand pattern may be selected depending on the purpose of use.

In the case where the leather-like sheet is used as a ball covering, preferably, a stone grain pattern is formed by a die pressing treatment, multiple cracks are formed in the recess bottom surface, and the fibers constituting the entangled fiber sheet are exposed through the cracks to secure water absorbability, non-slip performance, grip performance, a natural leather-like touch, wear resistance, and a like property in a well-balanced state.

The area of each projection top surface 2*a* is not specifically limited, but is preferably from 0.5 to 10 $mm^2$, and further preferably from 2 to 4 $m^2$ to secure excellent water absorbability, natural leather-like touch, and non-slip performance.

The thickness of the porous elastic resin layer 2 is preferably from 30 to 500 μm, and further preferably from 100 to 400 μm to secure both of wet grip performance and surface physical property. An unduly small thickness is likely to lower the mechanical property of a ball surface, the natural leather-like touch, and the grip performance, and an unduly large thickness is likely to lower the mechanical property of a ball surface, and the grip performance.

The leather-like sheet may be applied with a surface treatment such as a color treatment, as far as the openings satisfying the above requirements are formed in the surface of the porous elastic resin layer. However, in the case where a solvent-based ink or an aqueous-based ink obtained by mixing a pigment to a binder is coated by a gravure process, a spray process, or a like process, the openings tend to be clogged. In view of this, in the case where the surface of the leather-like sheet is colored, it is preferred to disperse a pigment in the porous elastic resin layer itself or perform a like treatment.

In the following, a method of producing the leather-like sheet of the embodiment is described.

The leather-like sheet of the embodiment is produced by: forming a porous elastic resin layer having a predetermined porous structure on a surface of a base material including an entangled fiber sheet; and contacting a die having a concave-convex configuration against a surface of the porous elastic resin layer in a pressing condition to be described later.

The kind of fibers for forming the entangled fiber sheet is not specifically limited, but microfine fibers with an average fineness of 0.3 dtex or less are preferably used in the case where the leather-like sheet is used as a ball covering.

The base material including the entangled fiber sheet composed of microfine fibers is produced by the following method.

The entangled fiber sheet composed of microfine fibers is produced by: forming a web constituted of sea-island fibers (so-called two-phase blend fibers) for forming microfine fibers; and subjecting the web to a microfine fiber forming treatment to be described later.

The sea-island fibers are obtained by spinning while combining or mixing two or more kinds of non-compatible thermoplastic polymers.

The kind of a polymer composing the island component (domain component) of the sea-island fibers is not specifically limited, as far as the polymer is melt-spinnable, has a higher melt viscosity than the melt viscosity of the polymer composing the sea component in a melt-spinning condition, has a large surface tension, and is capable of sufficiently exhibiting a fiber physical property such as a polymer strength.

Preferred examples of the island component polymer include: polyamide polymers such as nylon-6, nylon-66, nylon-610, nylon-612, and copolymers primarily containing the polyamide polymers; and polyester polymers such as polyethylene terephthalate, polypropylene terephthalate, polytrimethylene terephthalate, and polybutylene terephthalate, and copolymers primarily containing the polyester polymers.

Likewise, the kind of the polymer composing the sea component (matrix component) of the sea-island fibers is not specifically limited, as far as the polymer is melt-spinnable, has a lower melt viscosity than the melt viscosity of the island component polymer in a melt-spinning condition, has a higher dissolvability to a predetermined solvent or a higher decomposability to a predetermined decomposing agent than that of the island component polymer, and has a low compatibility to the island component polymer. Examples of the island component polymer include polyethylene, modified polyethylene, polypropylene, polystyrene, modified polystyrene, and modified polyester.

The volume ratio of the sea component/island component of the sea-island fibers is preferably in the range from 30/70 to 70/30 (volume %) to obtain a proper amount of microfine fibers whose fineness is 0.3 dtex or less. A leather-like sheet produced by using the microfine fibers has a high mechanical property and is suitably used as a ball covering. Also, since the amount of the sea component to be removed is properly defined, quality variation resulting from removal failure can be avoided, a treatment for treating the removed component can be eliminated, and the productivity can be increased. Thus, the method is also preferable in the aspect of industrial applicability.

In the case where the ratio of the sea component is 30 volume % or more, a proper amount of microfine fibers capable of securing softness is obtained. A leather-like sheet to be produced by using the microfine fibers has sufficient softness, without excessively using a fiber treating agent such as a softener. An excessive use of a fiber treating agent is likely to cause various drawbacks such as lowering of a mechanical property such as a tearing strength, an unwanted interactive action of the fiber treating agent, degradation of a natural leather-like touch, and lowering of durability. On the other hand, in the case where the ratio of the sea component is 70 volume % or less, a proper amount of microfine fibers capable of securing a mechanical property can be obtained.

A conventional melt-spinning method or a like method of forming sea-island fibers is used as the method of spinning sea-island fibers with no specific limitation. For instance, it is possible to use a known melt-spinning method of obtaining undrawn fibers comprises: simultaneously extruding melted resins of different components from respective corresponding spinning nozzles; combining or mixing the extruded components through the spinning nozzles in a melted state, and cooling the composite while drawing. The undrawn fibers obtained by melt-spinning undergo a post-processing such as an oiling treatment, a drawing treatment, and a crimping treatment.

Then, microfine fibers composed of the island component polymer are obtained by subjecting the undrawn fibers to a microfine fiber forming treatment, wherein the sea component polymer is removed by dissolution in a predetermined solvent or decomposition in a predetermined decomposing agent.

The timing of performing the microfine fiber forming treatment is not specifically limited. For instance, the microfine fiber forming treatment may be performed immediately after sea-island fibers are formed, or immediately after a web of sea-island fibers to be described later is formed, or immediately after a three-dimensionally entangled web is formed by three-dimensionally entangling sea-island fibers after a web of sea-island fibers is formed. Further alternatively, in the case where a porous polymeric elastic material to be described later is impregnated in an entangled fiber sheet, the microfine fiber forming treatment may be performed immediately after the porous polymeric elastic material is impregnated in the three-dimensionally entangled web. In this embodiment, an example is described, wherein the microfine fiber forming treatment is performed immediately after a porous polymeric elastic material is impregnated in a three-dimensionally entangled web.

The microfine fibers may be obtained by subjecting microfine-fiber forming fibers such as multi-layered fibers, or petaline layered fibers to a predetermined microfine fiber forming treatment, in place of the method comprising subjecting the sea-island fibers to the microfine fiber forming treatment, as described above. Specifically, microfine fibers of a predetermined polymer component are obtained by: applying a physical treatment to petaline layered fibers or multi-layered fibers of two or more kinds of non-compatible thermoplastic polymers for separating the different kinds of polymers at a boundary surface; or removing either one of the polymer components of multi-layered fibers composed of two or more kinds of non-compatible thermoplastic polymers by dissolution or decomposition.

Further alternatively, an entangled fiber sheet may be directly made of microfine fibers after the microfine fibers having a predetermined average fineness are obtained by direct spinning, in place of using the microfine fiber forming method comprising subjecting microfine-fiber forming fibers to the microfine fiber forming treatment.

In the following, a method of forming a web by using sea-island fibers is described.

The sea-island fibers for use in forming a web may be staple fibers or long fibers, and optionally selected depending on a web forming method. The web forming method is not specifically limited. It is possible to employ a conventional method of producing a knitted/woven fabric, a non-woven fabric, or a like fabric such as a carding method, a paper making method, or a spun bonding method, may be used with no specific limitation.

A three-dimensionally entangled web of sea-island fibers is formed by: layering web pieces to be a predetermined weight; and three-dimensionally entangling the sea-island fibers of the layered web by a needle punching method, a spun lacing method, or a like method.

An exemplified method of producing a three-dimensionally entangled web having a weight and fineness suitable for use in a ball covering is described in the following. First, a spun sea-island fiber is drawn to a length of about 1.5 to 5 times. Thereafter, the drawn fiber is subjected to a mechanical crimping treatment, and the crimped fiber is cut into a length of about 3 to 7 cm. Thereby, staple fibers are obtained. Then, a web piece of an intended fineness is formed by carding the staple fibers by a carding machine, and passing the carded fibers through a webber. The obtained web pieces are laminated into a layered web of an intended weight. Thereafter, the layered web is subjected to a needle punching treatment with use of a needle having one or more barbs at a rate of about 300 to 4,000 punches/cm$^2$. Thereby, a three-dimensionally entangled web, wherein the microfine fibers are entangled in a thickness direction, is obtained.

In the following, a method of impregnating a porous polymeric elastic material in an entangled fiber sheet is described. It is preferable to impregnate a porous polymeric elastic material in an entangled fiber sheet to improve the stitching performance in the case where a leather-like sheet is fabricated into a stitched ball, and enhance the touch, the texture, the repulsion, and a like property of the ball.

Examples of the method of impregnating a porous polymeric elastic material in an entangled fiber sheet include: a method comprising forming a composite of a three-dimensionally entangled web of sea-island fibers and a porous polymeric elastic material, and then, subjecting the sea-island fibers to a microfine fiber forming treatment; and a method comprising subjecting a three-dimensionally entangled web of sea-island fibers to a microfine fiber forming treatment to form an entangled fiber sheet of microfine fibers, and then, forming a composite of the entangled fiber sheet and a porous polymeric elastic material.

Examples of the method of forming a porous polymeric elastic material include: a method comprising coagulating a porous polymeric elastic material in a coagulation bath by a wet process using a solution containing polymeric elastic material; and a method comprising drying and solidifying a porous polymeric elastic material by a dry process using a aqueous dispersion containing polymeric elastic material dispersed with a foaming agent. The solution containing polymeric elastic material is an organic solution containing a polymeric elastic material. The aqueous dispersion containing polymeric elastic material is an aqueous dispersion obtained by dispersing or emulsifying a polymeric elastic material in an aqueous medium.

A polymeric elastic material for use in a conventional leather-like sheet producing method may be used with no specific limitation. Examples of the polymeric elastic material include polyurethane-based resins; polyester-based elastomers; various rubbers; polyvinyl chloride resins; polyacrylic-based resins; polyamino acid-based resins; silicone-based resins; and modifiers, copolymers, and mixtures of these resins. Among these, polyurethane-based resin is preferable to secure a texture, a mechanical property, and a like property in a well-balanced state.

Examples of the polyurethane resin include various polyurethanes produced by reacting polymer diol having an average molecular weight from 500 to 3,000, organic diisocyanate, and a chain extending agent at a predetermined molar ratio.

Examples of the polymer diol having an average molecular weight from 500 to 3,000 include polyester diol, polyether diol, polyester ether diol, polylactone diol, and polycarbonate diol. Examples of the organic diisocyanate include at least one kind of diisocyanate selected from organic diisocyanates including aromatic isocyanate such as trylene diisocyanate, xylylene diisocyanate, phenylene diisocyanate, and 4,4'-diphenylmethane diisocyanate; alicyclic isocyanate such as 4,4'-dicyclohexylmethane diisocyanate, and isophorone diisocyanate; and aliphatic isocyanate such as hexamethylene diisocyanate. Examples of the chain extending agent include a low molecular compound having at least two active hydrogen atoms such as diol, diamine, hydroxylamine, hydrazine, and hydrazide. These ingredients may be used alone or in combination of two or more kinds.

The polyurethane-based resin may be a mixture of different kinds of polyurethanes, or a resin composition containing a polymer such as synthetic rubber, polyester elastomer, or polyvinyl chloride, according to needs.

An exemplified wet process using a solution containing polymeric elastic material is a method comprising: impregnating a solution containing polymeric elastic material to an entangled fiber sheet; immersing the entangled fiber sheet in a coagulation bath to coagulate the polymeric elastic material in a porous state; and drying.

For instance, in the case where a polyurethane solution is used as the solution containing polymeric elastic material, impregnating the polyurethane solution to a three-dimensionally entangled web of sea-island fibers, and immersing the three-dimensionally entangled web in a coagulation bath containing a poor solvent of polyurethane enables to form porous polyurethane.

The kind of the solvent for the polyurethane solution is not specifically limited, as far as the solvent is capable of dissolving or diluting polyurethane. Specifically, for instance, dimethylformamide (DMF) is preferably used because a proper porous structure can be formed.

The concentration of the polyurethane solution is in the range from 10 to 25% in solid content, and preferably from 12 to 20% to secure a suitable solution viscosity, and an excellent texture of a leather-like sheet.

A representative example of the poor solvent of polyurethane is water.

In the polyurethane solution, an additive such as a coloring agent, a light resisting agent, or a dispersant; a coagulation adjuster for controlling the configuration of the porous structure; and the like may be added according to needs. Adding a coagulation adjuster is particularly preferred to obtain more uniform pores.

A composite of a three-dimensionally entangled web and porous polyurethane is formed by immersing the three-dimensionally entangled web impregnated with a polyurethane solution in a coagulation bath.

A preferred example of the coagulation bath is a mixture of water as a poor solvent of polyurethane, and DMF as a good solvent. The configuration, the number, and a like property of the pores to be formed can be controlled by adjusting the mixing ratio.

The mixing ratio of good solvent/poor solvent in the coagulation bath is preferably from 0/100 to 40/60 (mass ratio). The temperature of the coagulation bath is 50° C. or lower, and preferably 40° C. or lower. An unduly high temperature of the coagulation bath may reduce the coagulation speed, unduly increase the density of the porous structure, or obstruct formation of the porous structure.

A base material including a entangled microfine fiber sheet impregnated with a porous polymeric elastic material is obtained by: forming a composite of a three-dimensionally entangled web and a porous polymeric elastic material; and subjecting sea-island fibers to a microfine fiber forming treatment.

In the case where sea-island fibers are subjected to a microfine fiber forming treatment after a composite of a three-dimensionally entangled web and a porous polymeric elastic material is formed, cavities are formed between the microfine fibers and the porous polymeric elastic material by removal of the sea component. Thereby, the binding force between the microfine fibers by the porous polymeric elastic material is weakened. This is advantageous in obtaining a leather-like sheet having a soft texture.

In the case where a porous polymeric elastic material is formed after sea-island fibers are subjected to a microfine fiber forming treatment, in place of using the method of forming a composite of a three-dimensionally entangled web and a porous polymeric elastic material before sea-island fibers are subjected to a microfine fiber forming treatment, as described above, microfine fibers are strongly bound to each other by the polymeric elastic material. This is advantageous in obtaining a leather-like sheet having a hard texture. In the above case, a certain degree of soft texture can be secured by reducing the ratio of the polymeric elastic material in the base material. However, the aforementioned microfine fiber forming treatment is preferred to secure a solid and hard texture to be obtained by increasing the ratio of microfine fibers.

On the other hand, in the case where a dry process using an aqueous dispersion containing polymeric elastic material is performed, a composite of a three-dimensionally entangled web and a porous polymeric elastic material is formed by coating the aqueous dispersion containing polymeric elastic material containing a foaming agent on a base material, and then, the base material is heated and dried. In the case where an aqueous dispersion containing polymeric elastic material is impregnated to a three-dimensionally entangled web, and the three-dimensionally entangled web is dried without performing any treatment, a uniform base material may not be obtained, because the aqueous dispersion is migrated to the outer layer of the three-dimensionally entangled web. In view of the above, it is preferable to add a thermal sensitive gel to the aqueous dispersion containing polymeric elastic material. Adding the thermal sensitive gel enables to suppress migration of the aqueous dispersion, because the aqueous dispersion turns into gel by the heat applied in dry heating. In performing the above treatment, the porous polymeric elastic material can be uniformly coagulated in the thickness direction of an entangled fiber sheet by combining a steaming method, a far infrared heating method, and a like method.

A base material including a microfine entangled fiber sheet embedded with a porous polymeric elastic material can be produced by performing a microfine fiber forming treatment similarly to the wet process.

The mass ratio of microfine fibers/polymeric elastic material in the base material is preferably in the range from 35/65 to 65/35, in the case where a composite of a three-dimensionally entangled web and a porous polymeric elastic material is formed and then, sea-island fibers are subjected to a microfine fiber forming treatment; and is preferably in the range from 65/35 to 95/5, in the case where sea-island fibers are subjected to a microfine fiber forming treatment, and then, a porous polymeric elastic material is formed. Defining the mass ratio as described above is advantageous in obtaining a base material having a texture similar to the texture of a natural leather, which is generally preferred as a ball covering.

In the following, a method of forming a porous elastic resin layer on a surface of a base material including an entangled fiber sheet is described.

Examples of the porous elastic resin layer forming method include a method comprising coating a solution containing polymeric elastic material or an aqueous dispersion containing polymeric elastic material on a surface of a base material to a predetermined thickness with use of e.g. a knife coater, a bar coater, or a roll coater and treated by a wet process or a dry process.

An exemplified wet process comprises: coating a solution containing polymeric elastic material on a surface of a base material; immersing the base material in a coagulation bath containing a poor solvent to coagulate the polymeric elastic material in a porous state; and drying.

For instance, in the case where a polyurethane solution is used as the solution containing polymeric elastic material, coating the polyurethane solution on a base material, and immersing the base material in a coagulation bath containing a poor solvent of polyurethane enables to form porous polyurethane.

A preferred example of a solvent to the polyurethane solution is dimethylformamide (DMF) to form openings having a suitable number and a suitable size in a projection top surface.

The concentration of the polyurethane solution may depend on the kind of polyurethane, but is in the range from 10 to 30% in solid content, and more preferably in the range from 12 to 24% to secure a suitable number and a suitable size of openings to be formed in a projection top surface, and a suitable strength for a porous elastic resin layer. An unduly small concentration of the polyurethane solution is likely to reduce the density of the porous structure, thereby reducing the strength of the porous elastic resin layer; and also is likely to lower the solution viscosity, thereby making it difficult to form a porous elastic resin layer having a predetermined thickness. On the other hand, an unduly large concentration of the polyurethane solution may unduly increase the solution viscosity, thereby making it difficult to form a porous elastic resin layer having a predetermined thickness.

An additive such as a coloring agent, a light resisting agent, or a dispersant; a coagulation adjuster for controlling the configuration of a porous structure; and the like may be added according to needs. Adding a coagulation adjuster is preferred to obtain more uniform pores.

A porous elastic resin layer is formed on a surface of a base material by immersing the base material coated with a polyurethane solution on a surface thereof in a coagulation bath.

The mixing ratio of good solvent/poor solvent in the coagulation bath is preferably in the range from 0/100 to 40/60 (mass ratio) to form openings having a proper number and a proper size in a projection top surface of a porous elastic resin layer. The mixing ratio of good solvent/poor solvent in the range from 0/100 to 30/70 is preferred to form continuous holes communicating with the base material surface. Forming the continuous holes communicating with the base material surface is preferred to enhance water absorbability, and wet grip performance.

The temperature of the coagulation bath is 50° C. or lower, and preferably 40° C. or lower. An unduly high temperature of the coagulation bath may reduce the coagulation speed, unduly increase the density of the porous structure, or obstruct formation of the porous structure. Also, a concave-convex configuration is less likely to be formed.

In the case where a base material includes an entangled fiber sheet embedded with a porous polymeric elastic material, it is preferable to coagulate a polymeric elastic material to be impregnated in the base material, and a polymeric elastic material to be used in forming a porous elastic resin layer at one time. Coagulating a polymeric elastic material by a one-time treatment increases the production efficiency because a drying treatment following the coagulation is completed by a one-time treatment. Coagulation by a one-time treatment is also preferable, because the base material and the porous elastic resin layer are unitarily attached with improved contactability.

Examples of another method of forming a porous elastic resin layer on a surface of a base material include a method comprising: a dry process of coating an aqueous dispersion containing polymeric elastic material dispersed with a foaming agent on a base material surface, and then, coagulating the polymeric elastic material; coating an aqueous dispersion or a solution containing polymeric elastic material on a sheet such as a film or a release paper to form a porous elastic resin film by a wet process or by a dry process, and then, unitarily attaching the obtained film to the base material by adhesion via an adhesive agent, or by coating a treatment solution containing a polymeric elastic material dissolvable solvent on the film to re-dissolve the polymeric elastic material and adhere the film to the base material; and peeling a release paper. Further, there is proposed a method of unitarily attaching a porous elastic resin layer and a base material, while coagulating. The method comprises; coating a predetermined amount of a polymeric elastic material containing aqueous dispersing solution or a polymeric elastic material containing solution on a release paper or a like sheet; and attaching the sheet and the base material before coagulation or during coagulation.

Figure 3:
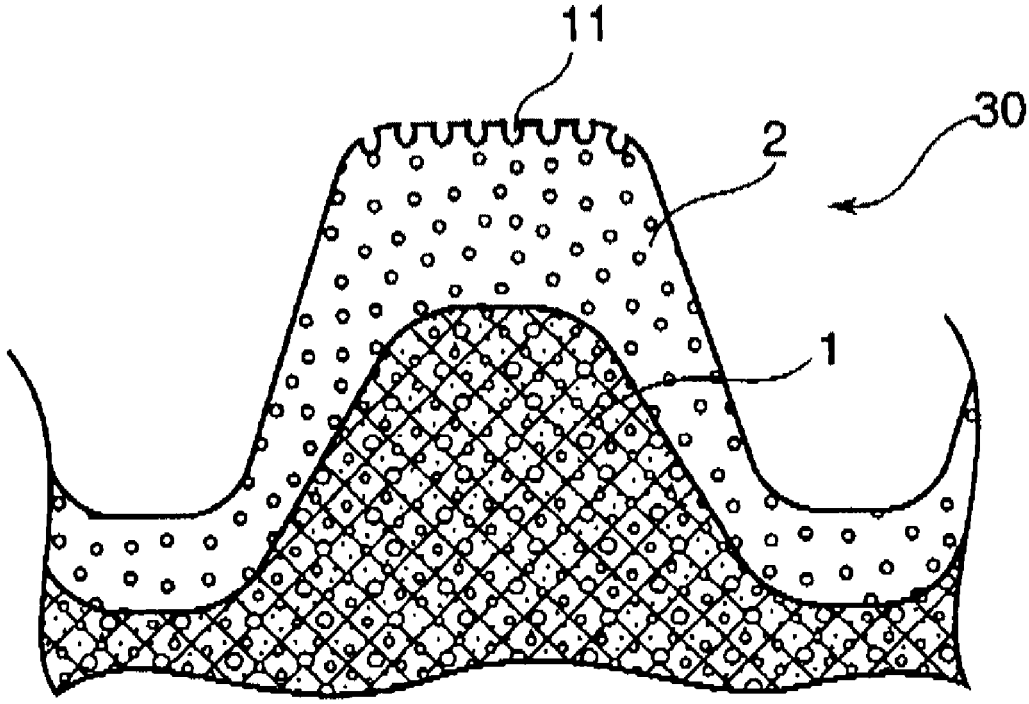
FIG. 3 is a schematic diagram for describing an internal structure of a projection in a method of producing the leather-like sheet of the embodiment.

The thickness of the porous elastic resin layer before a concave-convex configuration is formed is preferably in the range from 50 to 700 μm to form multitudes of microfine pores in a top surface of a projection to be formed on the porous elastic resin layer. An unduly small thickness of the porous elastic resin layer is likely to obstruct the die pressing treatment in forming a concave-convex configuration. An unduly large thickness of the porous elastic resin layer is likely to unduly increase the size of the openings to be formed in the projection top surface by stretching, or break the openings in forming a concave-convex configuration. The thickness in the range from 100 to 500 μm is particularly preferred to obtain a projection 30, as shown in FIG. 3, having an internal structure comprised of the porous elastic resin layer 2 as an outer layer, and the base material 1 as an inner layer. Forming the projection 30 having the internal structure on the leather-like sheet is preferable to enhance a mechanical property of the projection, and wet grip performance.

Preferably, a surface of the porous elastic resin layer may have openings with a diameter from 10 to 500 nm, preferably from 30 to 300 nm, and particularly preferably from 50 to 200 nm at a density of 1,000 openings/mm$^2$ or more, and preferably 1,500 openings/mm$^2$ or more. The aforementioned leather-like sheet is produced by transferring a concave-convex configuration of a die on the surface of the porous elastic resin layer having the aforementioned microfine pores with use of the die having the concave-convex configuration to be described later in a predetermined condition.

In the following, a method of forming a concave-convex configuration on a surface of a porous elastic resin layer is described referring to FIG. 4.

Figure 4:
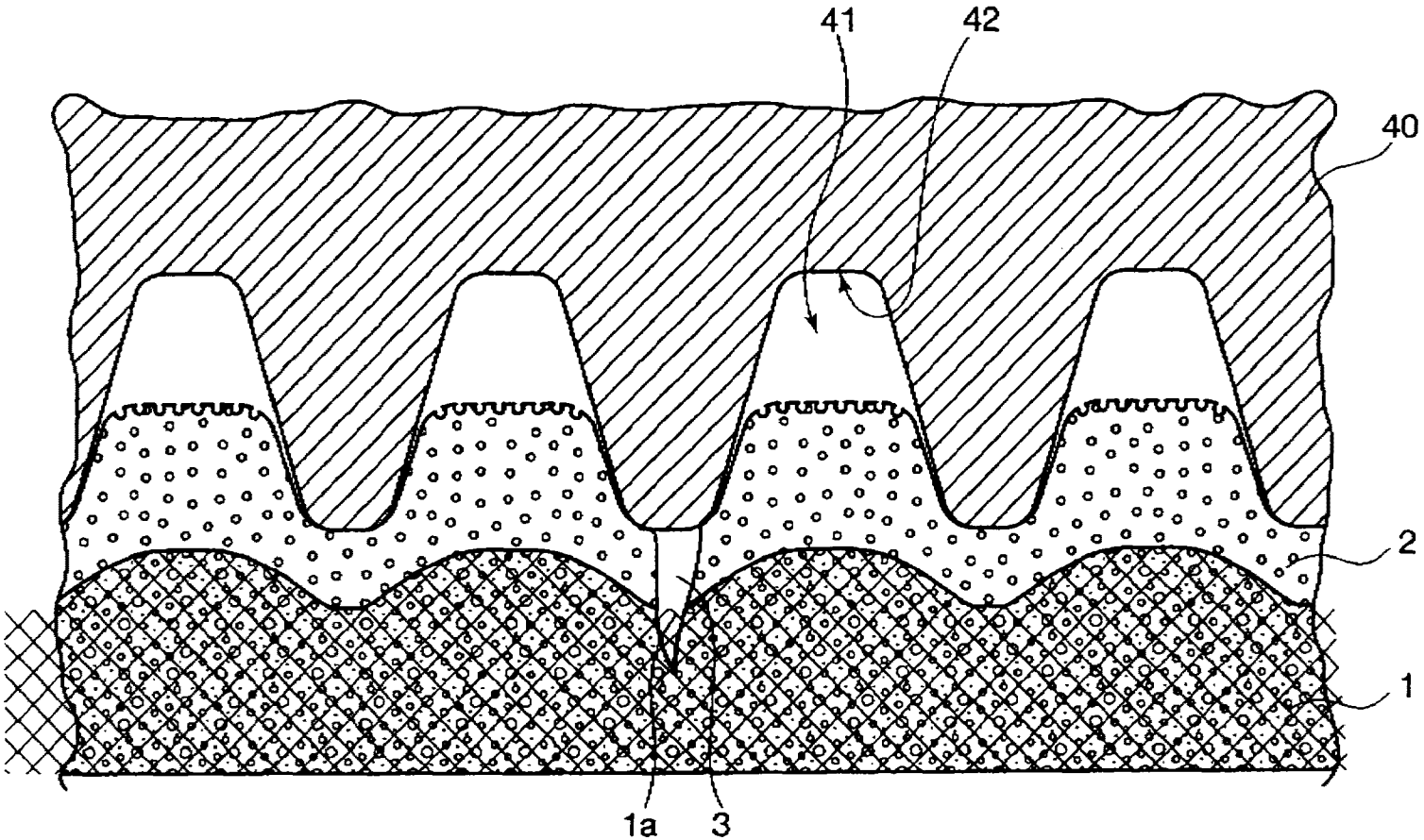
FIG. 4 is a schematic diagram for describing a step of forming a concave-convex configuration on a surface of the leather-like sheet in the leather-like sheet producing method of the embodiment.

Openings with a diameter from 10 to 500 nm (hereinafter, simply called as "microfine pores") at a density of 1,000 openings/mm$^2$ or more can be formed in a surface of the leather-like sheet of the embodiment by; as shown in FIG. 4, contacting a surface of the porous elastic resin layer 2 having multitudes of microfine pores against an emboss roll 40 having a concave-convex surface 42 with a height difference larger than the thickness of the porous elastic resin layer 2 in such a manner that the surface 42 of the emboss roll 40 is substantially not contacted with a portion 41 where a projection on the surface of the porous elastic resin layer 2 is to be formed. Forming the concave-convex configuration by the above method is preferable, because cracks 3 are easily formed in a recess bottom surface to be formed, and the fibers 1*a* constituting the entangled fiber sheet are easily exposed through a part of the cracks 3. The above method is particularly preferable to obtain a projection having an internal structure, wherein the outer layer is constituted of the porous elastic resin layer, and the inner layer is constituted of the base material.

Use of the emboss roll having the concave-convex surface with the height difference larger than the thickness of the porous elastic resin layer is advantageous, because the portion where the projection on the porous elastic resin layer surface is to be formed is less likely to be contacted with a recess (hereinafter, called as a "projection forming portion") in the emboss roll surface, and microfine pores can be retained in the projection top surface without clogging. Also, microfine pores in a recess bottom surface are easily blocked by melting or softening the recess bottom surface by a pressing force difference between a portion where a projection is to be formed, and a portion where a recess is to be formed in press contacting with the emboss roll, and a temperature difference resulting from the pressing force difference. Use of the emboss roll is advantageous in suppressing unduly increase of the size of microfine pores in the projection side surface, and breakage of the microfine pores by stretching, because application of an unduly large pressure to the projection side surface is avoided.

The average height difference of the concave-convex configuration of the emboss roll may depend on the thickness of the porous elastic resin layer, but is in the range from preferably about 250 to 1,000 μm, and further preferably about 500 to 700 μm in the case where the leather-like sheet is used as a ball covering.

Preferably, the emboss roll has projections (hereinafter, also called as "recess forming portions") on the concave-convex surface thereof with a smooth configuration, and a thickness capable of easily transferring a heat.

A preferred roll condition is; e.g. a roll surface temperature from 150 to 180° C. a pressing pressure from 5 to 50 kg/cm$^2$, and a processing time from 10 to 120 seconds, in the case where a porous elastic resin layer is made of polyurethane resin. A further preferred requirement of the roll condition is performing an embossing treatment in such a manner that an entangled fiber sheet is indented by a die pressing treatment or a like treatment to obtain a projection having an internal structure comprised of a porous elastic resin layer as an outer layer and a part of a surface of the entangled fiber sheet as an inner layer, and a recess substantially devoid of openings. In the modification, it is preferable to perform an embossing treatment at a roll surface temperature of 150° C. or more, and a pressing pressure of 7 kg/cm$^2$ or more, and more preferably 8 kg/cm$^2$ or more.

It is preferable to perform an embossing treatment with use of e.g. an emboss roll with a concave-convex configuration having a height difference larger than the thickness of the porous elastic resin layer at a pressing pressure of 9 kg/cm$^2$ or more to form cracks in a recess bottom surface and expose fibers constituting an entangled fiber sheet through the cracks.

Examples of the method of forming a concave-convex configuration include a method of transferring a concave-convex configuration with use of a flat emboss plate, and a method of transferring a concave-convex configuration with use of release paper having a concave-convex configuration, in addition to the method of forming a concave-convex configuration with use of an emboss roll.

However, the method using a flat emboss plate is not suitable in mass-production, because the method does not allow continuous treatment. The method using release paper having a concave-convex configuration has drawbacks that a concave-convex configuration with a height difference between a recess and a projection over 200 μm is less likely to be formed, and that a clear concave-convex configuration is less likely to be obtained in an attempt to secure a height difference from 200 to 300 μm. It is possible to form a clear concave-convex configuration by additionally applying a pressing force to the backside surface of release paper. However, applying an increased pressing force may result in a hard texture. In view of the above, the method of forming a concave-convex configuration with use of an emboss roll is preferred among the above methods.

It is not preferable to coat a solvent, an ink, or a like substance on a porous elastic resin layer having a concave-convex configuration on a surface thereof by the aforementioned method, because the openings may be blocked by coating the above substance on the porous elastic resin layer.

The inventive leather-like sheet has multitudes of microfine pores in a projection top surface of a concave-convex configuration. Accordingly, the inventive leather-like sheet enables to quickly absorb a water component such as sweat of a user's palm during use, and secure the touch and the grip performance substantially the same as in an initial stage of use, without using an auxiliary agent such as a grip enhancing agent or a penetrating agent. Accordingly, the inventive leather-like sheet is preferably used as a ball covering for a ball such as a basketball, an American football, a rugby ball, or a handball, and a non-slip covering.

As far as the openings in a projection can be maintained, an auxiliary agent such as a grip enhancing agent e.g. a rosin resin or a liquid rubber, a softener, a penetrating agent, or a water repellant may be applied to a projection where openings are formed, or inner surfaces of the openings.

EXAMPLES

In this section, the invention is described by way of Examples, but the invention is not limited to Examples described herein. In Examples, unless otherwise specifically indicated, the term "parts" indicates "parts by mass", and the term "%" indicates "% by mass".

First, an evaluating method in Examples is described in the following.

[Measurement on Number and Diameter of Opening Pores]

The surfaces of the leather-like sheets were observed by a scanning electron microscope at a magnification of 1,000 times, and an image of the observed surfaces was photographed. Ten projections were optionally selected from the image. The number of openings observed within a projection top surface, a projection side surface, and a recess bottom surface of a concave-convex configuration including the selected ten projections were counted, and the number of openings per 1 mm$^2$ was calculated. Also, an area of each of the openings was calculated by image processing. Then, imaginary circles each having an area equal to the area of the respective corresponding openings were defined, and the diameter of each of the imaginary circles was calculated. Then, an average diameter of openings was calculated by dividing the sum of the calculated diameters by the number of the openings.

[Wear Resistance]

The surface conditions of basketballs made of the leather-like sheets were observed after throwing each of the basketballs 20,000 times at a launching speed of 37 km/hour with an incident angle of 60 degrees against a plywood panel away from the throw position by 1.6 m to impart an impact force to the basketballs. The surface conditions of the basketballs were evaluated based on the following criteria.

Excellent: The external appearance hardly changed, or solely a partial wear was observed, as compared with a condition before an impact force was imparted. No peel of a skin layer was observed, with no or less conspicuous stains.

Poor: Peel of a skin layer was obviously observed around an air filling port of the ball, and stains on the ball surface were conspicuous.

[Water Absorbability]

The leather-like sheets were each cut into a circular sheet piece of 4 cm in diameter, and 0.2 mL water was dropped on a surface of each sheet piece. A water absorption state on each sheet piece surface was observed, while depressurizing the backside surface of each sheet piece. The water absorption state was evaluated based on the following criteria.

Excellent: Water on the surface was quickly absorbed.

Fair: Water was absorbed at a moderate speed.

Poor: Water was not absorbed.

[Touch on Ball Surface]

Touches on the basketballs made of the leather-like sheets by ten basketball players before practice were evaluated based on the following evaluation criteria. Judgment was made based on a majority opinion.

Excellent: Natural leather-like slimy touch was obtained.

Fair: More or less natural leather-like slimy touch was obtained.

Poor: No natural leather-like slimy touch was obtained.

[Evaluation on Wet Grip Performance]

Touches on the basketballs made of the leather-like sheets by the ten basketball players after practice in an environment of 28° C. were evaluated based on the following evaluation criteria. Judgment was made based on a majority opinion.

Excellent: After a long time playing, sufficient grip performance was obtained without slipping of the ball in catching the ball with a sweaty hand or hands.

Fair: After a long time playing, sufficient grip performance was not obtained in catching the ball with a sweaty hand or hands, although the ball was not so slippery.

Poor: After a long time playing, grip performance was poor, and the players frequently felt the ball slippery in catching the ball with sweaty hands.

Example 1

A two-phase mixed spun fiber (sea-island type) composed of 6-nylon as an island component, and low-density polyethylene as a sea component (island component/sea component=50/50 (mass ratio)) was produced by melt-spinning. The fiber was subjected to drawing, crimping, and cutting. Thereby, fiber staples of 5 dtex and 51 mm in cut length were obtained.

The fiber staples were subjected to carding by a carding machine, and then, web pieces were prepared by a cross-lapper. A predetermined number of web pieces were laminated to a layered web. Then, a non-woven fabric of 450 g/m$^2$ in unit area weight was obtained by subjecting the layered web to a needle punching treatment with use of a felting needle having one barb at a rate of 980 punches/cm$^2$.

Subsequently, the non-woven fabric was heated and dried, and the surface of the non-woven fabric was made smooth by pressing. Then, the smoothed non-woven fabric was impregnated with a 16% polyether polyurethane DMP solution. Then, the non-woven fabric impregnated with the solution was immersed in a 20% DMF aqueous solution. Thereby, a composite of polyurethane, and the non-woven fabric containing sponge-like coagulated polyurethane was obtained. Then, a base material including an entangled fiber sheet of 6-nylon microfine fibers and porous polyurethane was obtained by washing the composite with warm water, and dissolving and removing the polyethylene in the sea-island fibers in heated toluene.

Polyether polyurethane ("MP-145" of Dainippon Ink Chemical Industries Co., Ltd.) DMF solution (solid content: 20%) containing a brown pigment was coated in the amount of 350 g/m$^2$ on a surface of the base material. Then, the base material was coagulated in water, and dried. Thereby, a brown porous elastic resin layer of 400 μm in thickness was formed.

As a result of observing a surface of the porous elastic resin layer by a scanning electron microscope, it was confirmed that the resin layer surface had openings with a diameter from 10 to 500 nm at a density of about 7,000 openings/mm$^2$. The average diameter of the openings was 150 nm.

Then, the surface of the base material having the porous elastic resin layer was subjected to an embossing treatment with use of an emboss roll (about 700 μm in height difference of a concave-convex configuration of the emboss roll) for use in producing a basketball. Thereby, a leather-like sheet having a concave-convex configuration on a surface thereof was obtained. The embossing treatment was performed in the conditions: a roll surface temperature of 170° C., a pressing pressure of 10 kg/cm$^2$, and a processing time of 30 seconds in such a manner that the surface of the porous elastic resin layer was not substantially contacted with the recesses (convex forming portions) of the emboss roll.

Figure 5:
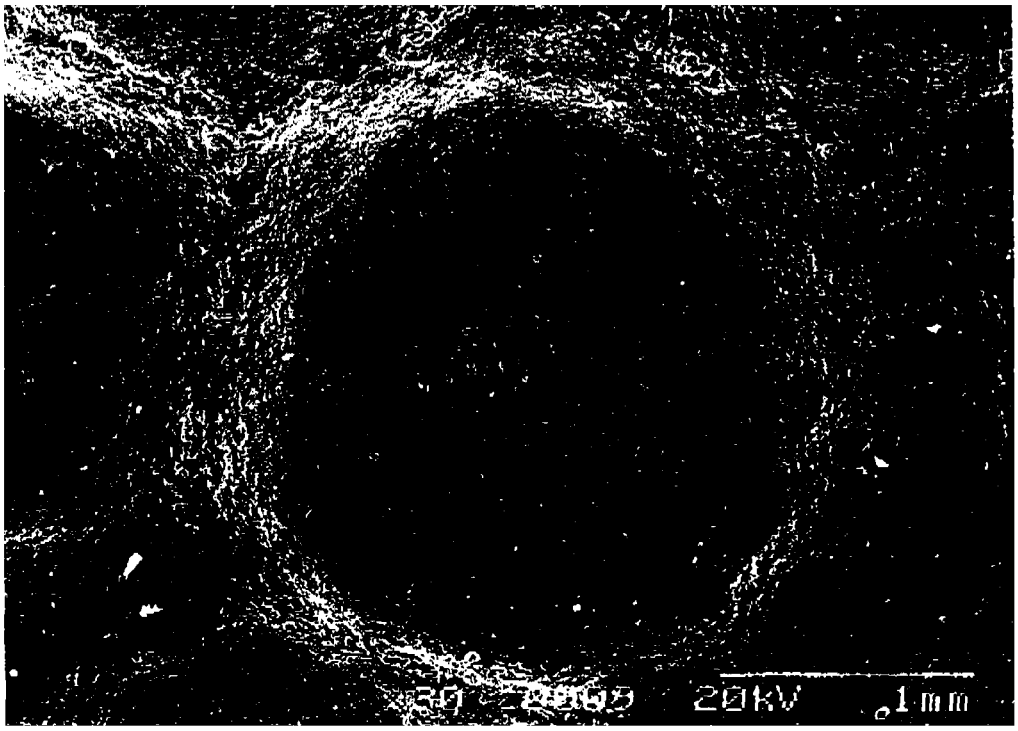
FIG. 5 is a micrograph showing a surface of a leather-like sheet produced in Examples.
Figure 6:
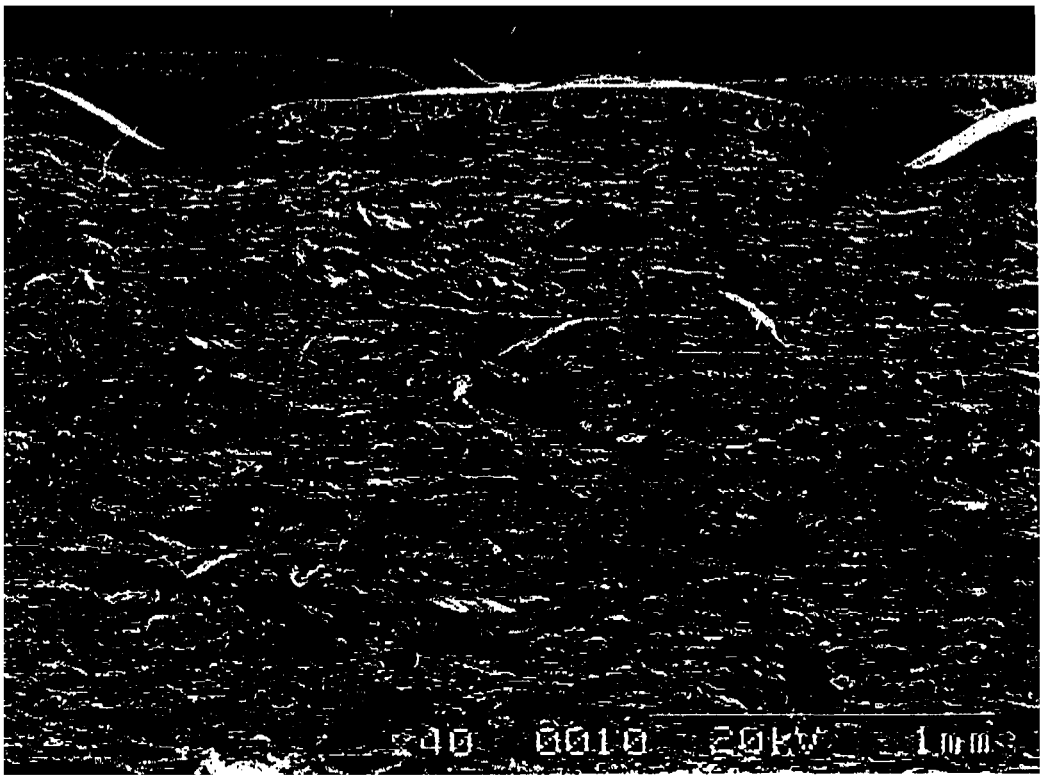
FIG. 6 is a micrograph showing a cross-section surface of a leather-like sheet produced in Examples.

Then, a surface of the leather-like sheet, and a cross section of the leather-like sheet obtained by slicing the leather-like sheet in vertical direction were observed by the scanning electron microscope. Microscopic images obtained by photographing are shown in FIGS. 5 and 6.

The leather-like sheet had a concave-convex configuration of 200 μm in average height difference. The top surfaces of the Projection had openings with a diameter from 10 to 500 nm at a density of about 5,000 openings/mm$^2$. The average diameter of the openings was 150 nm. The average surface area of the projection top surfaces was 3.1 mm$^2$.

No opening pore was observed in the recesses of the leather-like sheet, because the porous portion was pressed by a pressure applied by the emboss roll. As shown in the micrograph of FIG. 5, cracks were observed in the recess bottom surfaces, and the fibers constituting the entangled fiber sheet were exposed through a part of the cracks. Further, as shown in the micrograph of FIG. 6, the recess bottom surfaces around the projections were sunk while pressing the entangled fiber sheet of the base material. The projections having the internal structure, as shown in FIG. 3, comprised of the porous elastic resin layer as the outer layer, and a part of the surface of the entangled fiber sheet as the inner layer, were formed.

A basketball was produced using the leather-like sheet. Wear resistance, water absorbability, touch on ball surface, and wet grip performance were evaluated based on the aforementioned evaluation method. An evaluation result is shown in Table 1.

Example 2

Polyether polyurethane ("MP-145" of Dainippon Ink Chemical Industries Co., Ltd.) DMF solution (solid content: 20%) containing titanium oxide, a brown pigment, and a yellow pigment was coated in the amount of 400 g/m$^2$ on a surface of a base material produced by the method described in Example 1. Then, the polyether polyurethane was coagulated in water, and dried. Thereby, a beige porous elastic resin layer of 500 μm in thickness was formed.

As a result of observing a surface of the porous elastic resin layer by the scanning electron microscope, it was confirmed that the resin layer surface had openings with a diameter from 10 to 500 nm at a density of about 7,000 openings/mm$^2$. The average diameter of the openings was 150 nm.

Then, a leather-like sheet having a concave-convex configuration on a surface thereof was obtained by subjecting a surface of the base material having the porous elastic resin layer to an embossing treatment in the similar manner as Example 1 except that the roll surface temperature was 180° C. and the pressing pressure was 12 kg/cm$^2$.

The leather-like sheet had a concave-convex configuration of 400 μm in average height difference. Projection top surfaces of the leather-like sheet had openings with a diameter from 10 to 500 nm at a density of about 4,500 openings/mm$^2$. The average diameter of the openings was 120 nm. The average surface area of the projection top surfaces was 2.0 mm$^2$.

A basketball was produced using the leather-like sheet. Evaluation was made in the similar manner as Example 1. An evaluation result is shown in Table 1.

Example 3

Polyether polyurethane ("MP-185" of Dainippon Ink Chemical Industries Co., Ltd.) DMF solution (solid content: 20%) containing titanium oxide, a brown pigment, and a yellow pigment was coated in the amount of 350 g/m$^2$ on a surface of a base material produced by the method described in Example 1. Then, the polyether polyurethane was coagulated in water, and dried. Thereby, a beige porous elastic resin layer of 400 μm in thickness was formed.

As a result of observing a surface of the porous elastic resin layer by the scanning electron microscope, it was confirmed that the resin layer surface had openings with a diameter from 10 to 500 nm at a density of about 1,200 openings/mm$^2$. The average diameter of the openings was 100 nm.

Then, a leather-like sheet having a concave-convex configuration on a surface thereof was obtained by subjecting a surface of the base material having the porous elastic resin layer to an embossing treatment in the similar manner as Example 1 except that the roll surface temperature was 180° C. and the pressing pressure was 12 kg/cm$^2$.

The leather-like sheet had a concave-convex configuration of 400 μm in average height difference. Projection top surfaces of the leather-like sheet had openings with a diameter from 10 to 500 nm at a density of about 1,200 openings/mm$^2$. The average diameter of the openings was 100 nm. The average surface area of the projection top surfaces was 2.0 mm$^2$.

A basketball was produced using the leather-like sheet. Evaluation was made in the similar manner as Example 1. An evaluation result is shown in Table 1.

Comparative Example 1

Polyether polyurethane ("MP-145" of Dainippon Ink Chemical Industries Co., Ltd.) DMF solution (solid content; 20%) containing a brown pigment was coated in the amount of 500 g/m$^2$ on a surface of a base material produced by the method described in Example 1. Then, the polyether polyurethane was coagulated in water, and dried. Thereby, a brown porous elastic resin layer of 550 μm in thickness was formed.

As a result of observing a surface of the porous elastic resin layer by the scanning electron microscope, it was confirmed that the resin layer surface had openings with a diameter from 10 to 500 nm at a density of about 7,000 openings/mm$^2$. The average diameter of the openings was 150 nm.

Then, a concave-convex configuration was formed by subjecting a surface of the base material having the porous elastic resin layer to an embossing treatment in the similar manner as Example 1 except that the roll surface temperature was 120° C. and the pressing pressure was 12 kg/cm$^2$. Then, a leather-like sheet was obtained by coating an ester polyurethane ink containing a brown pigment on projection top surfaces by a gravure roll of 150 mesh.

The leather-like sheet had a concave-convex configuration of 200 μm in average height difference. Substantially no opening pore was observed in the projection top surfaces. Upper parts of projection side surfaces had openings with a diameter from 1 to 10 μm at a density of about 500 openings/mm$^2$. Recess bottom surfaces had openings with a diameter from 10 to 100 μm at a density of about 20 openings/mm$^2$. The average surface area of the projection top surfaces was 3.1 mm$^2$.

A basketball was produced using the leather-like sheet. Evaluation was made in the similar manner as Example 1. An evaluation result is shown in Table 1.

Comparative Example 2

Polyether polyurethane ("MP-145" of Dainippon Ink Chemical Industries Co., Ltd.) DMF solution (solid content: 20%) containing titanium oxide, a brown pigment, and a yellow pigment was coated in the amount of 400 g/m$^2$ on a surface of a base material produced by the method described in Example 1. Then, the polyether polyurethane was coagulated in water, and dried. Thereby, a beige porous elastic resin layer of 500 μm in thickness was formed.

As a result of observing a surface of the porous elastic resin layer by the scanning electron microscope, it was confirmed that the resin layer surface had openings with a diameter from 10 to 500 nm at a density of about 7,000 openings/mm$^2$. The average diameter of the openings was 150 mm.

Then, a leather-like sheet with concave-convex configuration was obtained by subjecting a surface of the base material having the porous elastic resin layer to an embossing treatment in the similar manner as Example 1 except that the roll surface temperature was 180° C. and the pressing pressure was 12 kg/cm$^2$.

Then, the projections on the leather-like sheet were polished in an area from the apexes of the projections to a depth corresponding to 10 μm by buffing at a rotation number of 1,000 rpm and a rotation speed of 5 m/min, with use of a sand paper (No. #320). Then, a leather-like sheet was obtained by applying one coat of an ester polyurethane ink containing a brown pigment on the polished surface by a gravure roll of 150 mesh.

The leather-like sheet had a concave-convex configuration of 300 μm in average height difference. The projection top surfaces had openings with a diameter from 5 to 100 μm at a density of 1,000 openings/mm$^2$. The average diameter of the openings was 10 μm. The average surface area of the projection top surfaces was 2.0 mm$^2$.

A basketball was produced using the leather-like sheet. Evaluation was made in the similar manner as Example 1. An Evaluation result is shown in Table 1.

Comparative Example 3

Polyether polyurethane ("MP-145" of Dainippon Ink Chemical Industries Co., Ltd.) DMF solution (solid content: 20%) containing titanium oxide, a brown pigment, and a yellow pigment was coated in the amount of 400 g/m$^2$ on a surface of a base material produced by the method described in Example 1. Then, the polyether polyurethane was coagulated in water, and dried. Thereby, a beige porous elastic resin layer of 500 μm in thickness was formed.

As a result of observing a surface of the porous elastic resin layer by the scanning electron microscope, it was confirmed that the resin layer surface had openings with a diameter from 10 to 500 nm at a density of about 7,000 openings/mm$^2$. The average diameter of the openings was 150 nm Then, a coat of DMF (dimethylformamide) solution was applied to the surface of the porous elastic resin layer by a gravure roll of 150 mesh. Thereafter, the porous elastic resin layer was left to stand for 3 minutes, and dried. As a result, large openings applied with a surface treatment by the organic solvent were formed.

Then, a leather-like sheet having a concave-convex configuration on a surface thereof was obtained by subjecting a surface of the base material having the porous elastic resin layer applied with the surface treatment by the organic solvent to an embossing treatment in the similar manner as Example 1 except that the roll surface temperature was 180° C. and the pressing pressure was 12 kg/cm$^2$.

Then, the leather-like sheet was colored by applying two coats of an ester polyurethane ink containing a brown pigment on the projection surfaces with use of a gravure roll of 150 mesh.

Substantially no opening pore was observed on the projection top surfaces of the leather-like sheet. Both of the projection side surfaces and the recess bottom surfaces had openings with a diameter from 5 to 100 μm at a density of about 1,000 openings/mm$^2$. The average diameter of the openings was 30 μm.

As a result of observing a surface of the porous elastic resin layer by the scanning electron microscope, it was confirmed that the resin layer surface had openings with a diameter from 10 to 500 nm at a density of about 1,200 openings/mm$^2$. The average diameter of the openings was 100 nm.

Then, a leather-like sheet having a concave-convex configuration on a surface thereof was obtained by subjecting a surface of the base material having the porous elastic resin layer to an embossing treatment by an emboss roll (about 300 μm in height difference of a convex and concave configuration of the emboss roll) for use in producing a basketball. The embossing treatment was performed in the conditions; a roll surface temperature of 170° C., a pressing pressure of 14 kg/cm$^2$, and a processing time of 60 seconds in such a manner that the surface of the porous elastic resin layer was fittingly contacted with the recesses (projection forming portions) of the emboss roll.

The leather-like sheet had a concave-convex configuration of 200 μm in average height difference. Substantially no opening pore was observed in the projection top surfaces of the leather-like sheet. A basketball was produced using the leather-like sheet. Evaluation was made in the similar manner as Example 1. An evaluation result is shown in Table 1.

TABLE 1

| | | EXAMPLE NO. | | | | | | |
|---|---|---|---|---|---|---|---|---|
| | | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 | COMPARATIVE EXAMPLE 4 |
| OPENINGS IN PROJECTION TOP SURFACE | NUMBER OF OPENINGS (per mm$^2$) | 5000 | 4500 | 1200 | 0 | 1000 | 0 | 0 |
| | DIAMETER | 10~500 nm | 10~500 nm | 10~500 nm | — | 5~100 μm | — | — |
| | AVERAGE DIAMETER | 150 nm | 120 nm | 100 nm | — | 10 μm | — | — |
| OPENINGS IN PROJECTION SIDE SURFACE | NUMBER OF OPENINGS (per mm$^2$) | 0 | 0 | 0 | 500 | 0 | 1000 | 0 |
| | DIAMETER | — | — | — | 1~10 μm | — | 5~100 μm | — |
| OPENINGES IN RECESS BOTTOM SURFACE | NUMBER OF OPENINGS (per mm$^2$) | 0 | 0 | 0 | 20 | 0 | 1000 | 0 |
| | DIAMETER | — | — | — | 10~100 μm | — | 5~100 μm | — |
| EVALUATION RESULT | WEAR RESISTANCE | EXCELLENT | EXCELLENT | EXCELLENT | EXCELLENT | POOR | EXCELLENT | EXCELLENT |
| | WATER ABSORBABILITY | EXCELLENT | EXCELLENT | EXCELLENT | POOR | EXCELLENT | FAIR | POOR |
| | TOUCH ON BALL SURFACE | EXCELLENT | EXCELLENT | EXCELLENT | POOR | FAIR | POOR | FAIR |
| | WET GRIP PERFORMANCE | EXCELLENT | EXCELLENT | EXCELLENT | POOR | POOR | FAIR | FAIR |

A basketball was produced using the leather-like sheet. Evaluation was made in the similar manner as Example 1. An evaluation result is shown in Table 1.

Comparative Example 4

Polyether polyurethane ("MP-185" of Dainippon Ink Chemical Industries Co., Ltd.) DMF solution (solid content: 20%) containing a brown pigment was coated in the amount of 350 g/m$^2$ on a surface of a base material produced by the method described in Example 1. Then, polyether polyurethane was coagulated in water, and dried. Thereby, a brown porous elastic resin layer of 400 μm in thickness was formed.

As shown in Table 1, the leather-like sheets produced in Examples 1 through 3 had superior properties all in wear resistance, water absorbability, touch on ball surface, and wet grip performance. On the other hand, the leather-like sheets produced in Comparative Examples 1 and 3, where no opening pore was formed in the projection top surfaces, had poor water absorbability, and lacked a natural leather-like slimy touch. The leather-like sheet produced in Comparative Example 2, where micro-sized openings were formed in the projection top surfaces, had good water absorbability, but the skin layer was peeled around the air filing port of the ball, and conspicuous stains were observed on the skin layer. The leather-like sheet produced in Comparative Example 4, where the porous elastic resin layer was subjected to an embossing treatment in contact with the entirety of the concave-convex surface of the emboss roll, had good wear resistance but poor water absorbability because the leather-like sheet was devoid of openings.

Chairs using the leather-like sheets produced in Examples on a surface thereof were produced to evaluate the leather-like sheets other than the leather-likes sheets for use in producing the balls. The chairs provided a good surface touch with no likelihood that the users seated in the chairs may feel the chairs slippery, with no sweat component remaining on the chair surfaces.

As another example, mobile phone cases using the inventive leather-like sheets were produced. The mobile phone cases provided a good surface touch without making the users feel the mobile phones slippery, even while the users hold the mobile phones with a sweaty hand.

As described above in detail, an aspect of the invention is directed to a leather-like sheet comprising; a base material including an entangled fiber sheet; and a porous elastic resin layer laminated on a surface of the base material, wherein the porous elastic resin layer has a concave-convex surface, the concave-convex surface of the porous elastic resin layer includes a projection having a top surface and a side surface, and a recess having a bottom surface contiguous to the side surface, and the top surface of the projection has openings with a diameter from 10 to 500 nm at a density of 1,000 openings/mm$^2$ or more. The leather-like sheet having the above arrangement has excellent water absorbability, provides a natural leather-like touch, and is suitably used as a ball covering or a non-slip covering, without lowering surface wear resistance.

In the leather-like sheet, preferably, the bottom surface of the recess may be substantially devoid of openings. The leather-like sheet having the above arrangement is advantageous in suppressing lowering of the apparent density of the bottom surface. Accordingly, the entirety of the surface of the leather-like sheet enables to keep wear resistance as required in a ball covering or a like member.

In the leather-like sheet, preferably, the side surface of the projection may be substantially devoid of openings. This arrangement enables to suppress the surface of the leather-like sheet from being smeared or stained.

In the leather-like sheet, preferably, the bottom surface of the recess may have a plurality of cracks, and a fiber constituting the entangled fiber sheet may be exposed through a part of the cracks. The above arrangement is advantageous in enhancing water absorbability by utilizing a capillary action of the fiber through the cracks. Thereby, a leather-like sheet having excellent water absorbability is obtained.

In the leather-like sheet, preferably, the projection may have an internal structure constituted of an outer layer and an inner layer, the outer layer being the porous elastic resin layer, and the inner layer being the base material including the entangled fiber sheet.

The above arrangement enables to produce a leather-like sheet having excellent grip performance and a relatively high surface wear resistance, and providing a natural leather-like touch.

In the leather-like sheet, preferably, the openings may include continuous holes communicating with the base material including the entangled fiber sheet. In this arrangement, since a water component on the surface of the leather-like sheet can be migrated to the entangled fiber sheet through the continuous holes, enhanced water absorbability can be obtained.

In the leather-like sheet, preferably, the porous elastic resin layer may be made of a polyurethane elastomer. This arrangement is particularly advantageous in providing the leather-like sheet with a texture similar to a texture of natural leather, and providing a natural leather-like touch.

In the leather-like sheet, preferably, the base material may contain a porous polymeric elastic material. This arrangement is particularly advantageous in providing the leather-like sheet with a texture similar to a texture of natural leather, and providing a natural leather-like touch.

Another aspect of the invention is directed to a ball having the leather-like sheet on a surface thereof. The ball having the above arrangement has a relatively high surface wear resistance, and excellent water absorbability, and provides a natural leather-like touch.

Yet another aspect of the invention is directed to a non-slip covering including the leather-like sheet on a surface thereof. The non-slip covering having the above arrangement has a relatively high surface wear resistance, and excellent water absorbability, and provides a natural leather-like touch.

Still another aspect of the invention is directed to a method of producing a leather-liker sheet including; a porous elastic resin layer forming step of forming a porous elastic resin layer on a surface of a base material including an entangled fiber sheet; and a transferring step of contacting a die having a concave-convex surface with a surface of the porous elastic resin layer to form a concave-convex configuration on the surface of the porous elastic resin layer, wherein the porous elastic resin layer has openings with a diameter from 10 to 500 nm at a density of 1,000 openings/mm$^2$ or more in the surface thereof, the concave-convex surface of the die includes a number of projection forming portions for forming projections on the surface of the porous elastic resin layer, and a number of recess forming portions contiguous to the projection forming portions, and the contact is performed in such a manner that the openings with the diameter from 10 to 500 nm are formed at the density of 1,000 openings/mm$^2$ or more in a top surface of the projection of the porous elastic resin layer having the concave-convex configuration. The above arrangement enables to produce a leather-like sheet having excellent water absorbability, providing a natural leather-like touch, and suitably used as a ball covering or a non-slip covering, without lowering surface wear resistance.

In the production method, preferably, the contact may be performed in such a manner that the concave forming portions of the die are contacted with the surface of the porous elastic resin layer, and the convex forming portions of the die are substantially in non-contact with the surface of the porous elastic resin layer. The above arrangement enables to easily form openings with a diameter from 10 to 500 nm at a density of 1,000 openings/mm$^2$ or more in the top surface of the projection.

In the production method, preferably, a height difference of the concave-convex surface on the die may be larger than a thickness of the porous elastic resin layer. The above arrangement enables to easily form openings with a diameter from 10 to 500 nm at a density of 1,000 openings/mm$^2$ or more in the top surface of the projection.

The invention claimed is:

1. A leather-like sheet comprising:

a base material including an entangled fiber sheet; and a porous elastic resin layer laminated on a surface of the base material, wherein the porous elastic resin layer has a concave-convex surface, the concave-convex surface of the porous elastic resin layer comprising a plurality of projections each having a top surface and a side surface, and a recess having a bottom surface contiguous to the side surface, and the top surface of each projection has openings with a diameter from 10 to 500 nm at a density of 1,000 openings/mm$^2$ or more.

2. The leather-like sheet according to claim 1, wherein the bottom surface of the recess is substantially devoid of openings.

3. The leather-like sheet according to claim 1, wherein the side surface of the projection is substantially devoid of openings.

4. The leather-like sheet according to claim 1, wherein the bottom surface of the recess has a plurality of cracks, and a fiber constituting the entangled fiber sheet is exposed through a part of the cracks.

5. The leather-like sheet according to claim 1, wherein the projection has an internal structure constituted of an outer layer and an inner layer, the outer layer being the porous elastic resin layer, and the inner layer being the base material comprising the entangled fiber sheet.

6. The leather-like sheet according to claim 1, wherein the openings comprise continuous holes communicating with the base material including the entangled fiber sheet.

7. The leather-like sheet according to claim 1, wherein the porous elastic resin layer is made of a polyurethane elastomer.

8. The leather-like sheet according to claim 1, wherein the base material comprises a porous polymeric elastic material.

9. The leather-like sheet according to claim 1, wherein the openings have a diameter of from 30 to 300 nm.

10. The leather-like sheet according to claim 1, wherein the openings have a diameter of from 50 to 200 nm.

11. The leather-like sheet according to claim 1, wherein the density is 1,500 openings/mm$^2$ or more.

12. The leather-like sheet according to claim 1, wherein the density does not exceed 10,000 openings/mm$^2$.

13. The leather-like sheet according to claim 1, wherein the top surface of each projection has an area of 0.5 to 10 mm$^2$.

14. The leather-like sheet according to claim 1, wherein the top surface of each projection has an area of 2 to 4 mm$^2$.

15. A ball having the leather-like sheet according to claim 1 on a surface thereof.

16. A basketball having the leather-like sheet according to claim 1 on a surface thereof.

17. A non-slip covering including the leather-like sheet according to claim 1 on a surface thereof.

18. A method of producing a leather-liker sheet comprising:

a porous elastic resin layer forming step of forming a porous elastic resin layer on a surface of a base material including an entangled fiber sheet; and a transferring step of contacting a die having a concave-convex surface with a surface of the porous elastic resin layer to form a concave-convex configuration on the surface of the porous elastic resin layer, wherein the porous elastic resin layer has openings with a diameter from 10 to 500 nm at a density of 1,000 openings/mm$^2$ or more in the surface thereof, the concave-convex surface of the die includes a number of projection forming portions for forming projections on the surface of the porous elastic resin layer, and a number of recess forming portions contiguous to the projection forming portions, and the contact is performed in such a manner that the openings with the diameter from 10 to 500 nm are formed at the density of 1,000 openings/mm$^2$ or more in a top surface of the projection of the porous elastic resin layer having the concave-convex configuration.

19. The method of forming a leather-like sheet according to claim 18, wherein the contact is performed in such a manner that the concave forming portions of the die are contacted with the surface of the porous elastic resin layer, and the convex forming portions of the die are substantially in non-contact with the surface of the porous elastic resin layer.

20. The method of forming a leather-like sheet according to claim 18, wherein a height difference of the concave-convex surface on the die is larger than a thickness of the porous elastic resin layer.

* * * * *